US009543684B1

(12) United States Patent
Engerman et al.

(10) Patent No.: US 9,543,684 B1
(45) Date of Patent: Jan. 10, 2017

(54) TRIM PANEL

(71) Applicant: Nissan North America, Inc., Franklin, TN (US)

(72) Inventors: Eric Engerman, Northville, MI (US); Zachary Stoklosa, Ferndale, MI (US); Brian Shepard, Ypsilanti, MI (US); Ronald Morrow, Novi, MI (US); George Henry Gasahl, IV, Farmington Hills, MI (US)

(73) Assignee: NISSAN NORTH AMERICA, INC., Franklin, TN (US)

( * ) Notice: Subject to any disclaimer, the term of this patent is extended or adjusted under 35 U.S.C. 154(b) by 0 days.

(21) Appl. No.: 14/920,035

(22) Filed: Oct. 22, 2015

(51) Int. Cl.
*H01R 13/60* (2006.01)
*H01R 13/443* (2006.01)

(52) U.S. Cl.
CPC ..... *H01R 13/443* (2013.01); *H01R 2201/26* (2013.01)

(58) Field of Classification Search
CPC ..... H01R 13/443
USPC ..... 439/528, 34, 148
See application file for complete search history.

(56) References Cited

U.S. PATENT DOCUMENTS 7,682,189 B2 * 3/2010 Yamaguchi ..... H01R 13/443 439/148
7,862,098 B2 * 1/2011 Biggs ..... B60K 37/06 296/37.8

* cited by examiner

*Primary Examiner* — Phuong Dinh
(74) *Attorney, Agent, or Firm* — Global IP Counselors, LLP

(57) ABSTRACT

A trim panel having a main body, a plurality of attachment structures and a dummy electric connector. The main body has a trim surface and an attachment surface opposite the trim surface. The plurality of attachment structures are formed on the attachment surface and are configured to contact and engage a separate panel securing the main body to the separate panel and covering an aperture formed in the separate panel. The dummy electric connector is formed on the attachment surface. The dummy electric connector is configured to receive and retain an electric connector in the absence of any electrical contacts within or on the dummy electric connector. The dummy electrical connector enables retention of a wiring harness having a connector that is not currently used, the unused connector to be connected to and retained by the dummy connector.

19 Claims, 8 Drawing Sheets

TRIM PANEL

BACKGROUND

Field of the Invention

The present invention generally relates to trim panel having a dummy connector. More specifically, the present invention relates to a trim panel with a dummy connector that attaches to an unused electrical connector.

Background Information

As automotive manufacturing processes become more streamlined, it is more cost effective to manufacture a single wiring harness for a model vehicle that includes duplicate connectors that are used for the same purpose but at different locations within a vehicle. For example, a rear brake lamp is required at a centered area of a rear end of a vehicle. In some versions of a specific model vehicle, the rear brake lamp is installed to a rear shelf within a passenger compartment adjacent to a rear window. In other versions of the same model vehicle where a rear spoiler is installed to a trunk lid of the vehicle, the brake lamp can be included within the structure of the rear spoiler. In such a circumstance, two electric connectors are provided in a single vehicle wiring harness for that model vehicle. One of the connectors is used when the brake lamp is installed to the rear shelf, and the other connector is used when the brake lamp is installed within the rear spoiler.

SUMMARY

One object of this disclosure is to provide a rear shelf of a vehicle with a panel having a dummy connector that receives and retains an unused electric connector.

In view of the state of the known technology, one aspect of the present disclosure include a trim panel having a main body having a trim surface and an attachment surface opposite the trim surface. A plurality of attachment structures formed on the attachment surface that are configured to contact and engage a separate panel securing the main body to the separate panel and covering an aperture formed in the separate panel. A dummy electric connector is formed on the attachment surface. The dummy electric connector is configured to receive and retain an electric connector in the absence of any electrical contacts within or on the dummy electric connector.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
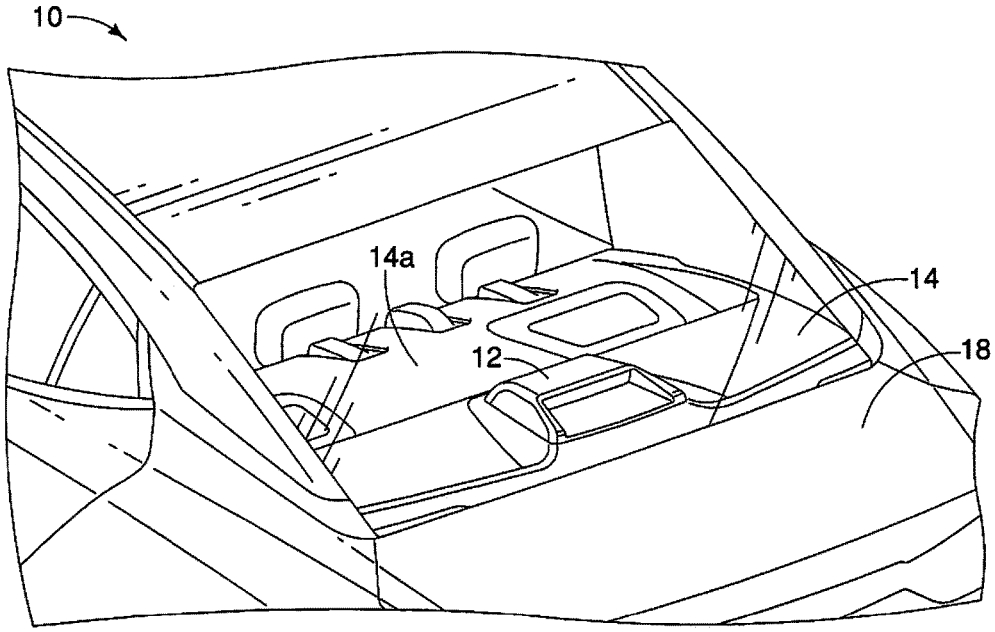
FIG. 1 is a perspective view of a rear portion of a vehicle having a brake lamp assembly installed to a rear shelf in accordance with a first embodiment.
Figure 2:
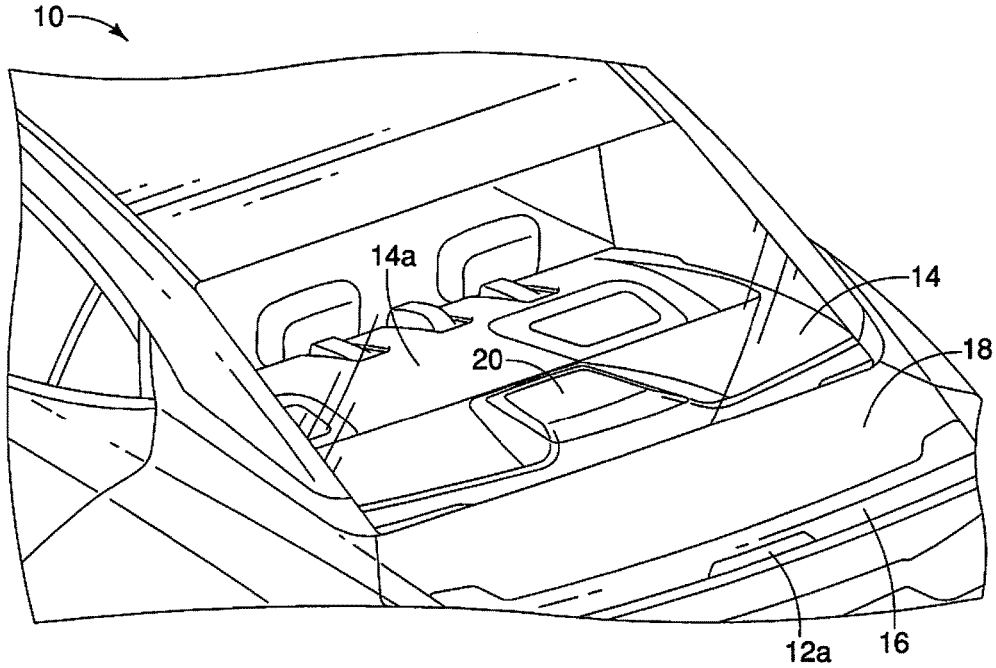
FIG. 2 is a perspective view of the rear portion of the vehicle having a rear spoiler with a brake lamp assembly and the rear shelf having a trim panel covering an aperture dimensioned to receive a brake lamp assembly in accordance with the first embodiment.

Referring initially to FIGS. 1 and 2 show a vehicle 10. In FIG. 1, the vehicle 10 is provided with a brake lamp assembly 12 that is mounted to a rear shelf 14 within a passenger compartment of the vehicle. In FIG. 2, the brake lamp assembly 12 has been removed from the rear shelf 14 of the vehicle 10, and instead the vehicle 10 includes an optional rear spoiler 16 mounted to a trunk lid 18 of the vehicle 10. As shown in FIG. 2, the rear spoiler 16 includes a brake lamp assembly 12*a*. As shown in FIG. 2, with the brake lamp assembly 12 missing from the rear shelf 14, the vehicle 10 is provided with a trim panel 20 mounted to the rear shelf 14 in place of the brake lamp assembly 12 in accordance with a first embodiment. As described in greater detail below, the trim panel 20 includes a dummy connector 22 (shown in FIG. 6) that is configured to retain an electric connector 24 (shown in FIG. 8) that would otherwise be connected to the brake lamp assembly 12, providing power thereto.

Figure 3:
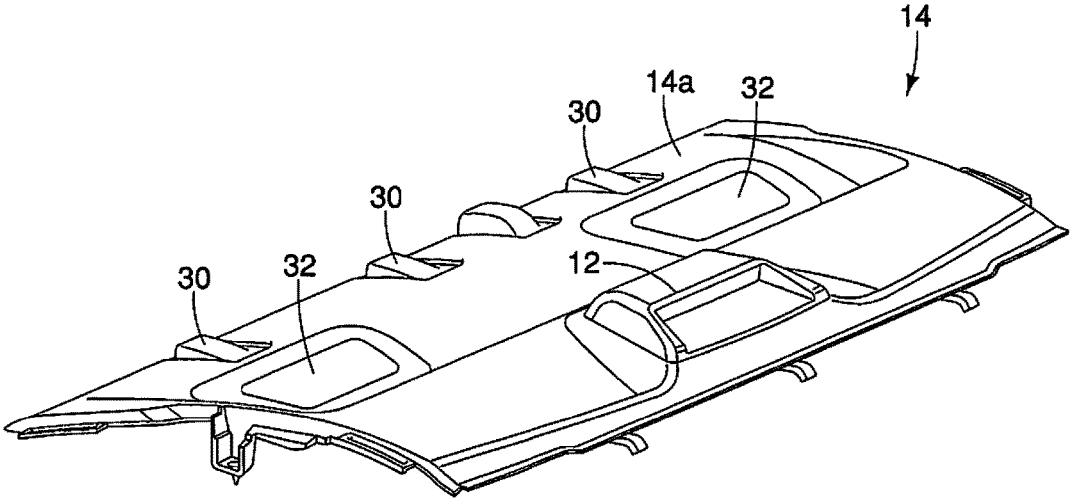
FIG. 3 is a perspective view of the rear shelf shown removed from the vehicle, the rear shelf having the brake lamp assembly installed thereto covering the aperture in accordance with a first embodiment.
Figure 4:
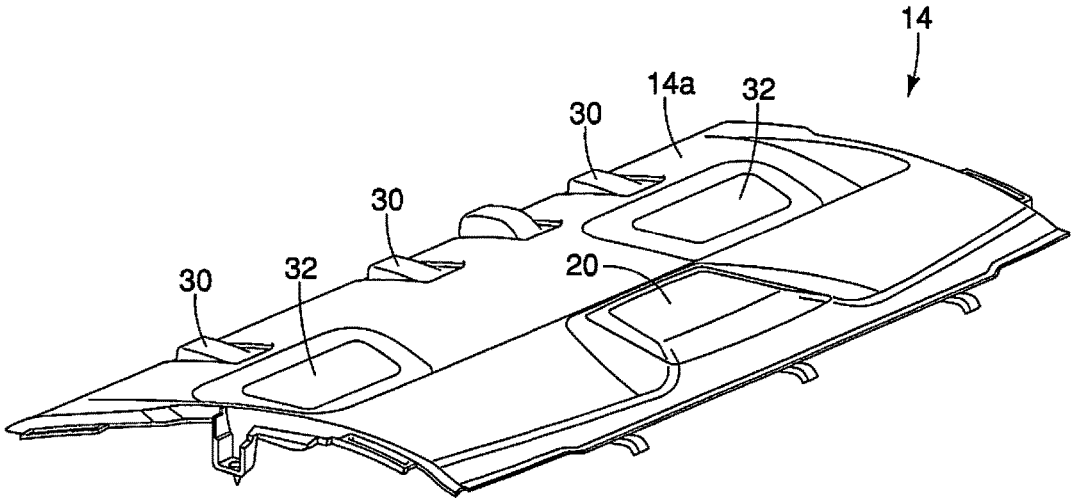
FIG. 4 is a perspective view of the rear shelf similar to FIG. 3 having the trim panel installed covering the aperture dimensioned to receive a brake lamp assembly in accordance with the first embodiment.

In FIG. 3, the rear shelf 14 is shown removed from the vehicle 10 with the brake lamp assembly 12 installed. FIG. 4 shows the rear shelf 14 removed from the vehicle 10 with the brake lamp assembly 12 removed and the trim panel 20 installed in its place.

It should be understood from the drawings and the description herein that the present disclosure is directed to the vehicle 10 that includes the trim panel 20 as shown in FIGS. 2 and 4. The depictions in FIGS. 1 and 3 are provided to show a contrast between the inclusion of the brake lamp assembly 12 and its omission in FIGS. 2 and 4, where the trim panel 20 is used to fill the space otherwise occupied by the brake lamp assembly 12. More specifically, the instant disclosure is directed to the vehicle 10 shown in FIGS. 2 and 4 where the spoiler 16 is provided with the brake lamp assembly 12*a* and the trim panel 20 is employed on the rear shelf 14 in the absence of the brake lamp assembly 12 on the rear shelf 14.

Figure 5:
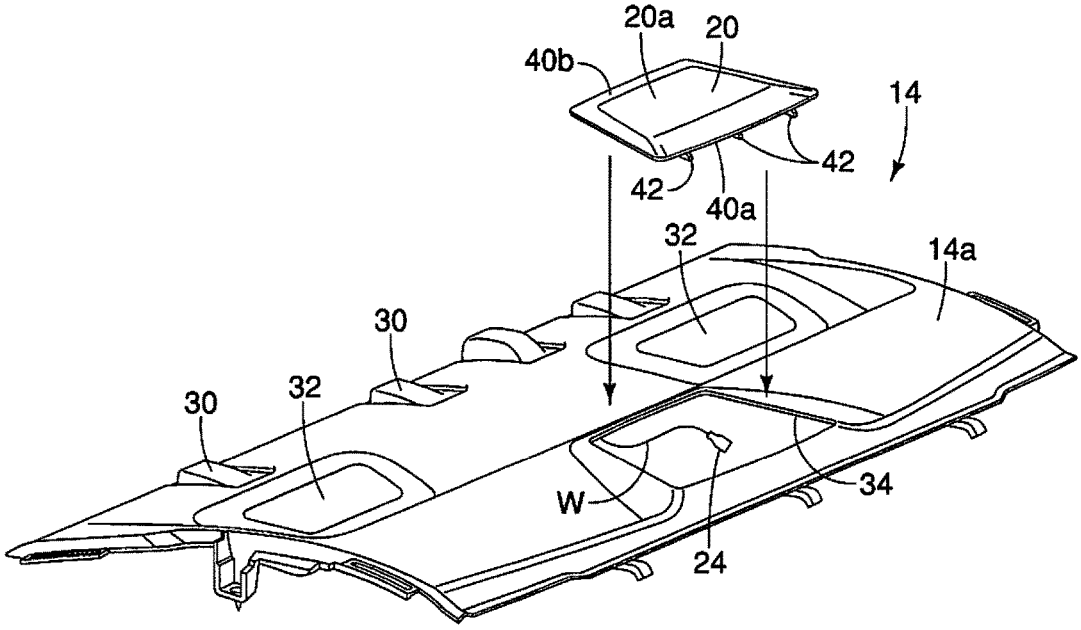
FIG. 5 is an exploded perspective view of the rear shelf showing the aperture of the rear shelf with the trim panel prior to installation in accordance with the first embodiment.
Figure 14:
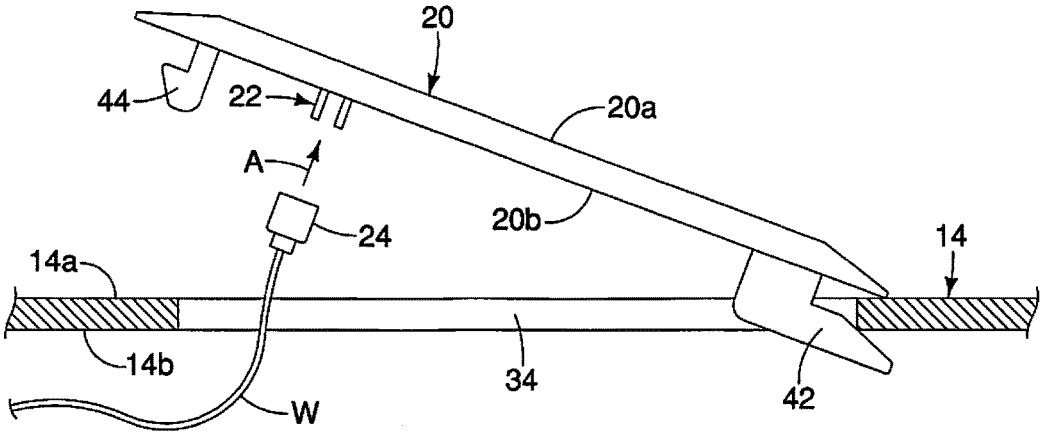
FIG. 14 is a cross-sectional view of the rear shelf and the trim panel showing the trim panel and the electric connector in the process of being installed to the rear shelf in accordance with the first embodiment.
Figure 15:
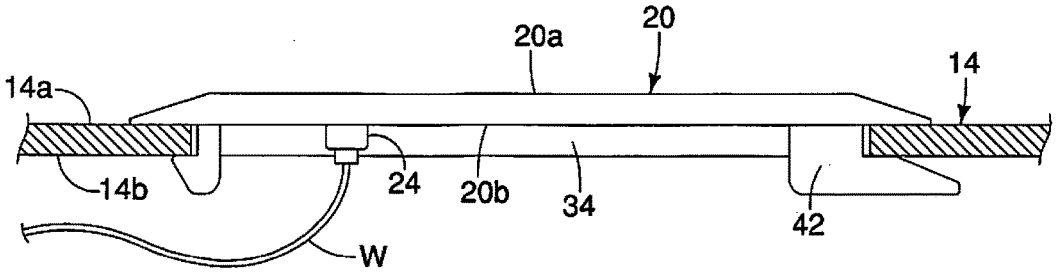
FIG. 15 is another cross-sectional view of the rear shelf and the trim panel similar to FIG. 14 showing the trim panel installed to the rear shelf and the electric connector installed to the dummy connector in accordance with the first embodiment.

As shown in FIG. 5, the rear shelf 14 includes a finished surface 14*a* and also includes a bottom surface 14*b* shown in FIGS. 14 and 15. The rear shelf 14 is formed with a number of features such as seat belt receiving portions 30, audio speaker receiving portions 32 and an aperture 34 that extends through the rear shelf 14 from the finished surface 14*a* to the bottom surface 14*b*. The aperture 34 is dimensioned and shaped to receive and retain the brake lamp assembly 12, and in the absence of the brake lamp assembly 12, also receives and retains the trim panel 20.

The rear shelf 14 basically defines a rear shelf also referred to as the P-shelf within the passenger compartment of the vehicle 10 adjacent to and protected by a rear window of the vehicle 10 in a conventional manner. Since the rear shelf 14 is a conventional feature of the vehicle 10, further description is omitted for the sake of brevity.

A description of the trim panel 20 is now provided with specific reference to FIGS. 5-15. The trim panel 20 has a main body 40 having a trim surface 20*a* and an attachment surface 20*b* opposite the trim surface 20*a*. The trim surface 20*a* can includes surface contours and shapes that blend in with and/or complement the appearance of the finished surface 14*a* of the rear shelf 14. Since such surface contours and shapes relate to a design appearance of the interior of the vehicle 10 and can vary from vehicle to vehicle, further description is omitted for the sake of brevity.

Figure 6:
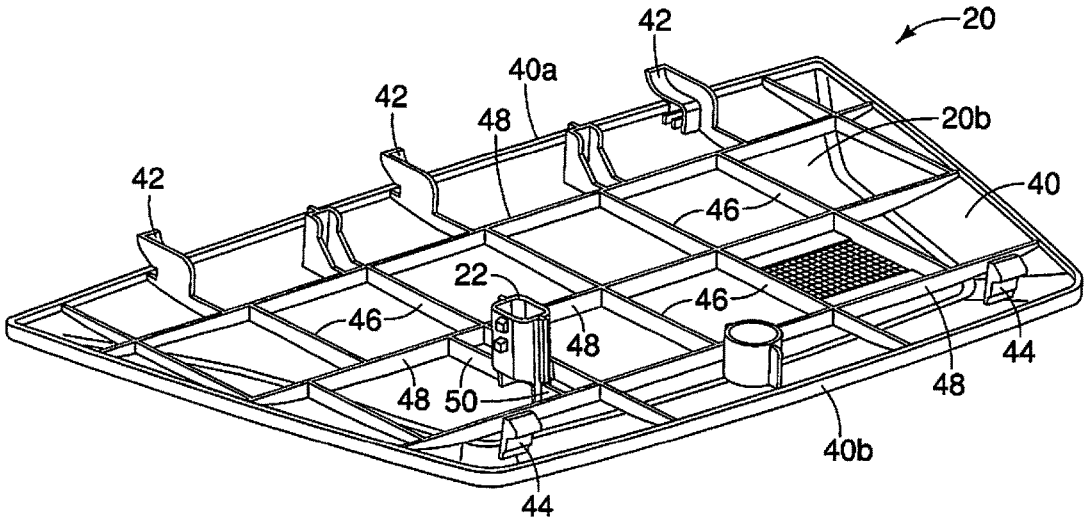
FIG. 6 is a perspective view of the rear shelf showing an attachment side having a plurality of connector projection and a dummy connector in accordance with the first embodiment.

As shown in FIG. 6, the attachment surface 20*b* of the trim panel 20 includes a first set of attachment structures 42, a second set of attachment structures 44, a plurality of first ribs 46, a plurality of second ribs 48, reinforcing ribs 50 and 52, and the dummy connector 22.

The first set of attachment structures 42 are formed on the attachment surface 20*b* adjacent to a rearward edge 40*a* of the main body 40. The attachment structure 42 project downward and rearward forming a hook-like shape, as shown in FIGS. 14 and 15. It should be noted that in FIG. 6, the trim panel 20 is upside down with the attachment surface 20*b* facing upward and with a forward edge 40*d* of the main body 40 being at the front of the depiction in FIG. 6.

The second set of attachment structures 44 extend downward from the attachment surface 20*b* and are generally perpendicular to the main body 40. Each of the attachment structure 44 has a hook or barb defining snap-fitting projections, as shown in FIGS. 14 and 15.

The attachment surface 20*b* of the trim panel 20 includes the plurality of first ribs 46 that extend from the rearward edge 40*a* to the forward edge 40*b*. The plurality of second ribs 48 extend along the attachment surface 20*b* of the trim panel 20 in directions perpendicular to the first ribs 46. The reinforcing ribs 50 are short ribs formed adjacent to and under the dummy connector 22 in a direction parallel to the first ribs 46. The reinforcing rib 52 is perpendicular to the reinforcing ribs 50.

The attachment structures 42 and 44 are configured to extend through the aperture 34 of the shelf panel 14 (a separate panel) such that the attachment structures 42 and 44 contact and engage the shelf panel 14 in order to secure the main body 40 of the trim panel 20 to the shelf panel 14 covering aperture 34, as shown in FIGS. 14 and 15. However, once the trim panel 20 is installed to the shelf panel 14, the main body 40 of the trim panel 20 is located along and above the shelf panel 14, with only the attachment structures 42 and 44 (and the dummy connector 22) extending through the aperture 34 below the shelf panel 14.

A description of the dummy connector 22 is now provided with specific reference to FIGS. 7-13. The dummy connector 22 (also referred to as a dummy electric connector) is integrally formed on the attachment surface 20*b* of the main body 40 of the trim panel 20. In other words, in the depicted embodiment the dummy connector 22 is integrally formed with the trim panel 20 as a single, unitary monolithic element. The dummy connector 22 is configured to receive and retain the electric connector 24 in order to restrict movement of the electric connector 24 when not in use (in the absence of the brake lamp assembly 12). The dummy connector 22 is formed without electric contacts or wires. In other words, there are no actual electric connections incorporated into the dummy connector 22. The dummy connector 22 is formed and used in the absence of any electrical contacts within or on the dummy connector 22. Rather, the dummy connector 22 is provided to hold the electric connector 24 when the electric connector 24 is not needed or used.

Figure 11:
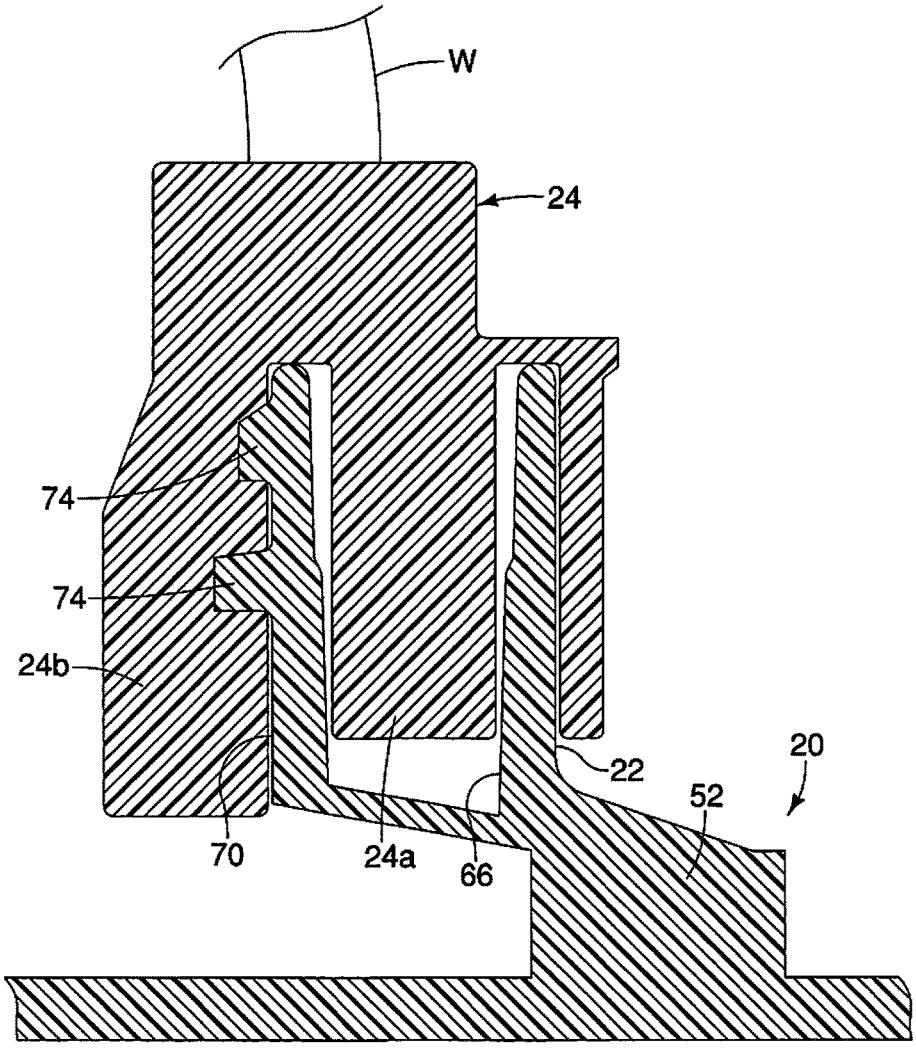
FIG. 11 is another cross-sectional view of the dummy connector similar to FIG. 10 showing the electric connector attached to the dummy connector in accordance with the first embodiment.
Figure 13:
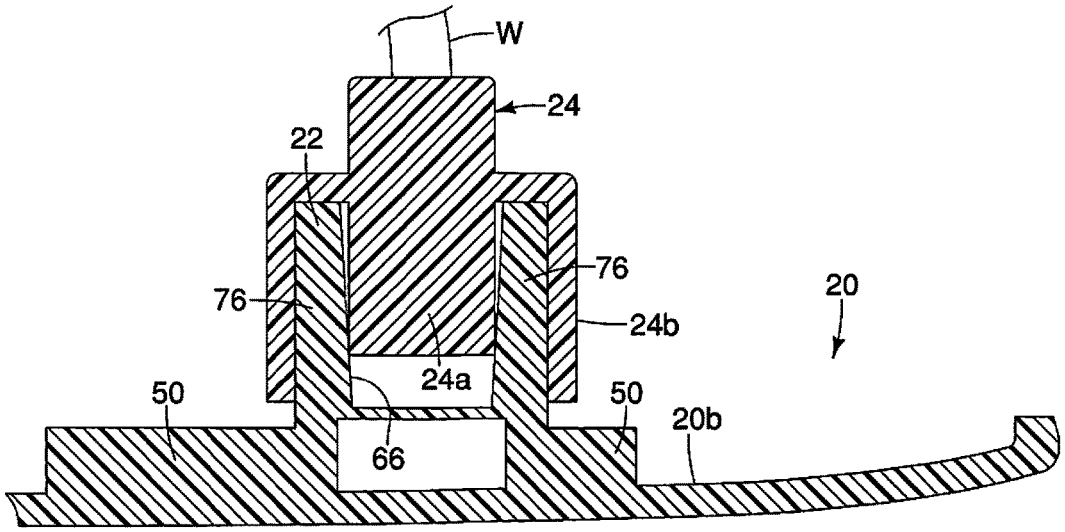
FIG. 13 is a cross-sectional view of the dummy connector taken similar to FIG. 12 showing the electric connector attached to the dummy connector in accordance with the first embodiment.

The dummy connector 22 includes a hollow structure having a first end 60 fixed to the attachment surface 20*b* of the main body 40 and a second end 62 space apart from the attachment surface 20*b*. The second end 62 has an opening 64 exposing a hollow interior 66 of the hollow structure. The hollow interior 66 is configured to receive at least an inner portion 24*a* of the electric connector 24, as shown in FIGS. 11 and 13. The dummy connector 22 has an outer surface that includes a first outer surface portion 70 and second outer surface portions 72. In the first embodiment, the first outer surface portion 70 and the second outer surface portions 72 are perpendicular to the attachment surface 20*b* of the main body 40 of the trim panel 20.

Figure 7:
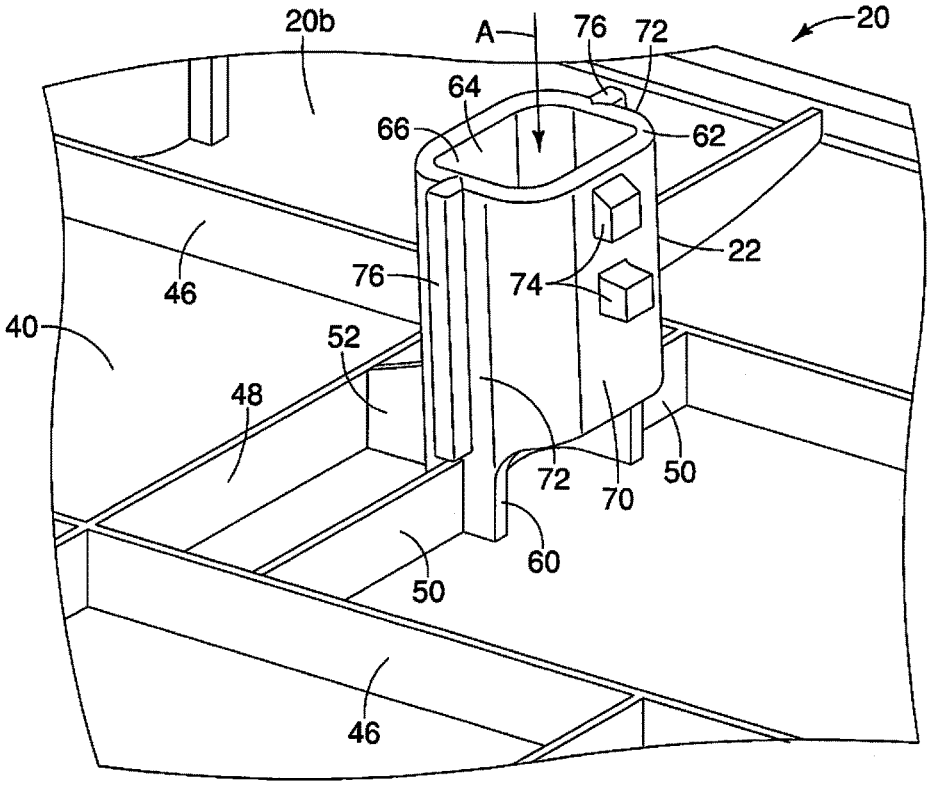
FIG. 7 is a perspective view of a portion of the attachment side of the trim panel showing details of the dummy connector that extends in a direction perpendicular to a main body of the trim panel in accordance with the first embodiment.
Figure 10:
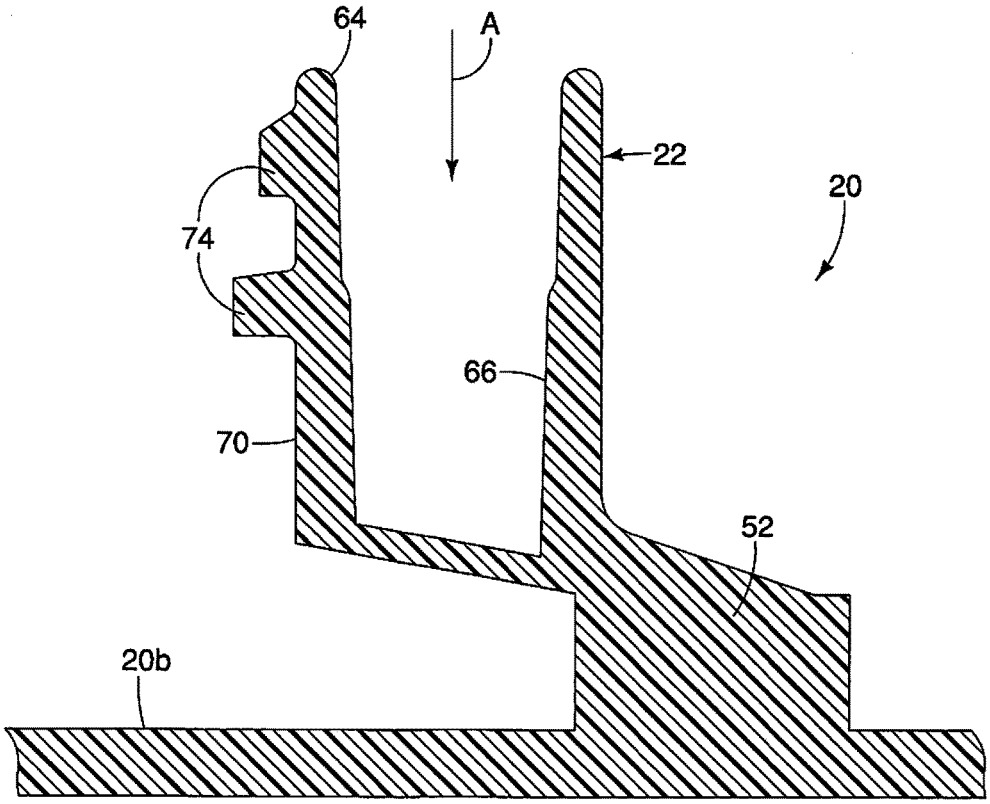
FIG. 10 is a cross-sectional view of the dummy connector taken along the lines 10-10 in FIG. 9 in accordance with the first embodiment.

The first outer surface portion 70 includes a pair of electric connector retaining projections 74 that extend therefrom, as shown in FIGS. 7 and 10. The electric connector retaining projections 74 mate with corresponding recesses form within the electric connector 24, as shown in FIG. 11. The second outer surface portions 72 are also perpendicular to the first outer surface portion 70 and are located at either side of the first outer surface portion 70. Each of the second outer surface portions 72 includes an alignment rib 76 extending therefrom. The alignment ribs extends in directions perpendicular to the attachment surface 20*b*.

Figure 12:
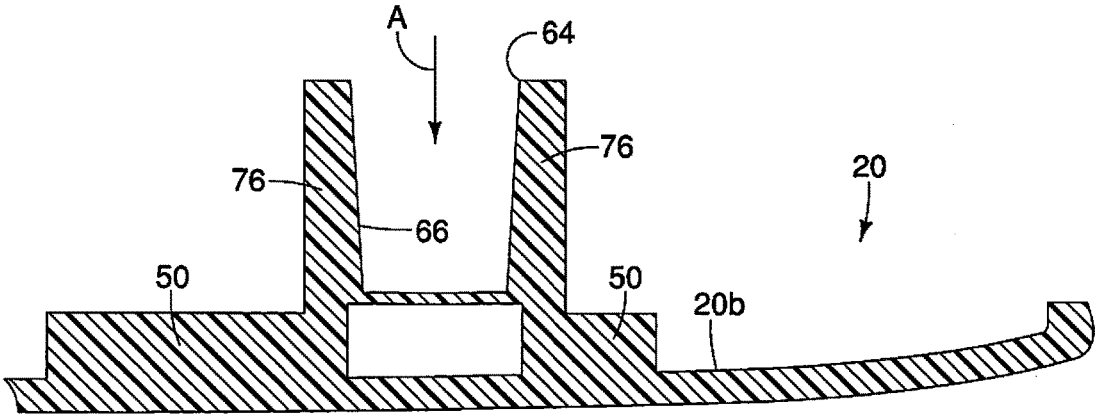
FIG. 12 is another cross-sectional view of the dummy connector taken along the lines 12-12 in FIG. 9 in accordance with the first embodiment.

As indicated by the arrow A in FIGS. 7, 10 and 12, the dummy connector 22 defines an insertion direction for attachment to the electric connector 24 that is also perpendicular to the attachment surface 20*b*.

As shown in FIGS. 13-16, the electric connector 24 is attached to a wiring harness W that extend to various other areas of the vehicle 10 in a conventional manner. Since wiring harnesses are conventional vehicle features, further description of the wiring harness W is omitted for the sake of brevity. The electrical connector 24 includes the inner portion 24*a* and an outer portion 24*b* that surrounds the inner portion 24*a*. The inner portion 24*a* includes electric contacts (not shown) configured to provide electricity to the brake lamp assembly 12, which is not installed. The electric contacts are connected to the wiring harness W in a conventional manner. Since electric contacts are conventional features, further description is omitted for the sake of brevity.

As mentioned above, the electric connector 24 is configured to attach to the brake lamp assembly 12. However, since the function of the brake lamp assembly 12 is not necessary due to inclusion of the brake lamp assembly 12*a* in the rear spoiler 16, the electric connector 24 is attached to the dummy connector 22 in order to prevent movement of the electric connector 24 and protect the electric contacts therein against debris.

Figure 8:
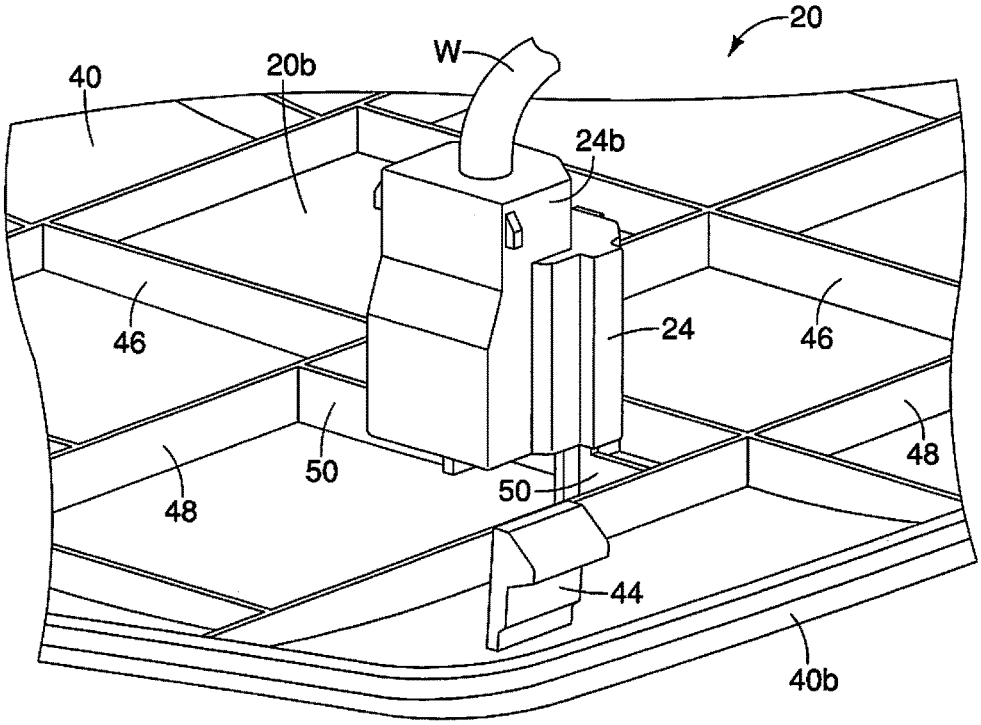
FIG. 8 is another perspective view of the portion of the attachment side of the trim panel similar to FIG. 7 showing an electric connector attached to the dummy connector in accordance with the first embodiment.
Figure 9:
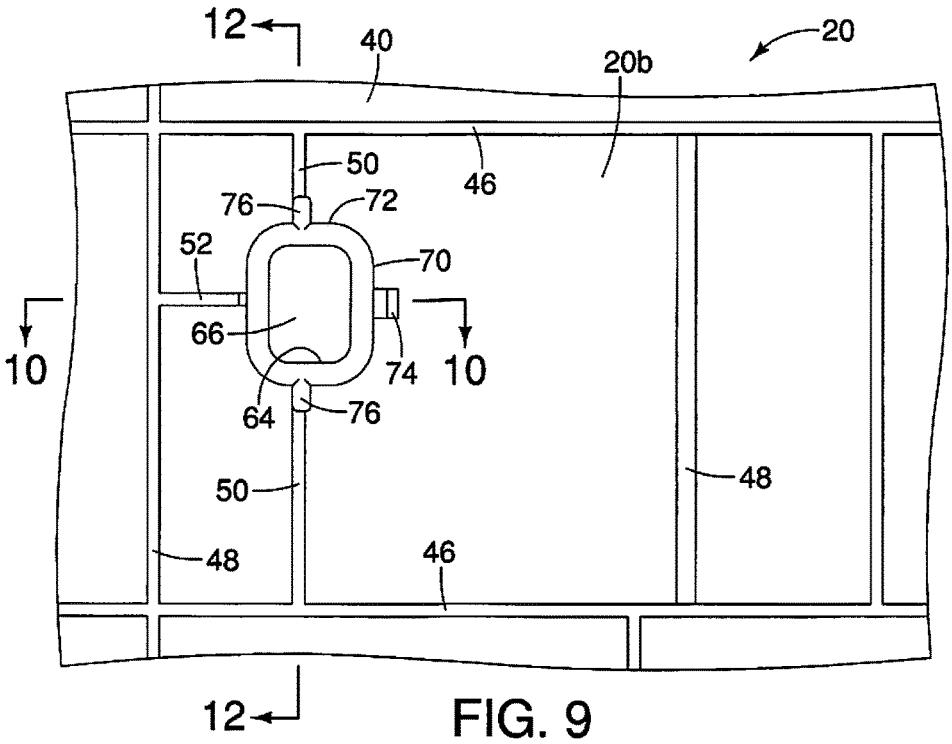
FIG. 9 is a top view of the portion of the attachment side of the trim panel showing details of the dummy connector in accordance with the first embodiment.

As shown in FIGS. 8, 11 and 13, the outer portion 24*b* of the electric connector 24 slips over and around the dummy connector 22 engaging the electric connector retaining projections 74 and the alignment ribs 76. The inner portion 24*a* of the electric connector 24 extends into the hollow interior 66 of the dummy connector 22. The electric connector retaining projections 74 fit into recesses formed in the outer portion 24*b* of the electric connector 24 locking the electric connector 24 to the dummy connector 22. Further, as shown in FIG. 9, the alignment ribs 76 are not centered relative to the second outer surface portions 72 of the dummy connector 22. The outer portion 24*b* of the electric connector 24 includes corresponding alignment ribs such that the electric connector 24 can only install to the dummy connector 22 in a specific orientation.

Once the electric connector 24 is secured to the dummy connector 22 prior to installation of the trim panel 20 to the shelf panel 14, as shown in FIG. 14. Thereafter as shown in FIG. 15, the trim panel 20 is installed to the shelf panel 14 thereby securing the trim panel 20 to the shelf panel 14 and securing the electric connector 24 to the trim panel 20. This arrangement protects the electric connector 24 and prevents unwanted movement of the wiring harness W that extends from the electric connector 24.

Figure 16:
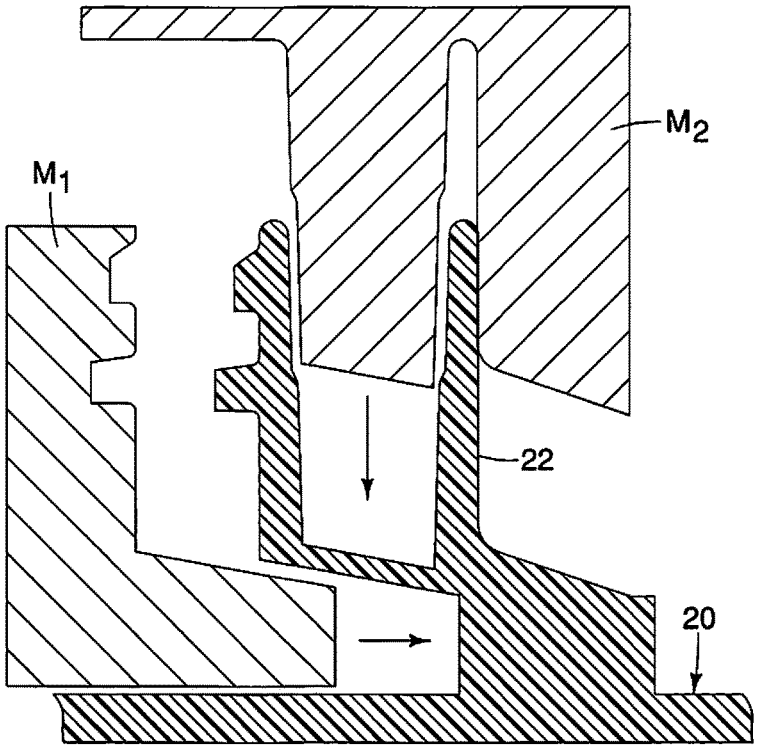
FIG. 16 is a cross-sectional view showing molds used to mold the dummy connector of the trim panel in accordance with the first embodiment.

The dummy connector 22 is preferably molded integrally with the trim panel 20, as is shown schematically in FIG. 16. A first mold $M_1$ and a second mold $M_2$ are used in combination with panel molds (not shown) in order to form the dummy connector 22 with the trim panel 20 in a single injection molding process.

Second Embodiment

Figure 17:
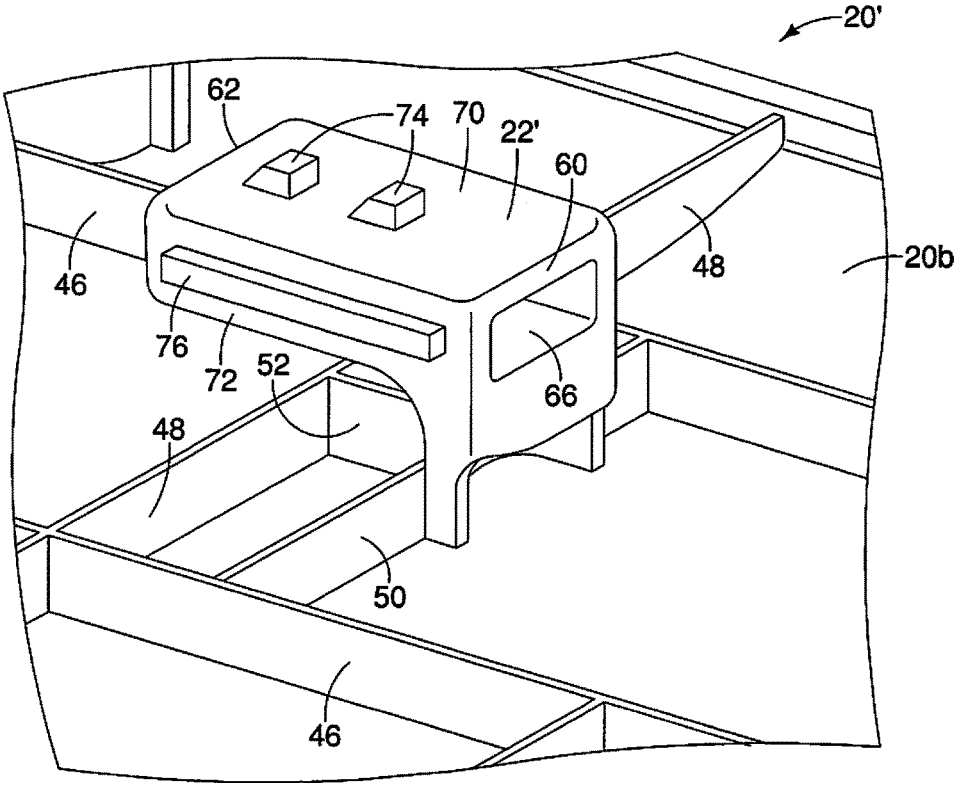
FIG. 17 is a perspective view of a portion of an attachment side of a trim panel showing details of a dummy connector that extends in a direction parallel to a main body of the trim panel in accordance with a second embodiment.

Referring now to FIG. 17, a trim panel 20' in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity. The parts of the second embodiment that differ from the parts of the first embodiment will be indicated with a single prime (').

In the second embodiment, the trim panel 20' includes all of the features of the trim panel 20 of the first embodiment except that the orientation of a dummy connector 22' of the second embodiment differs from the dummy connector 22 of the first embodiment. Specifically, the trim panel 20' includes the attachment surface 20*b*, the ribs 46 and 48. However, the dummy connector 22' extends in a direction that is parallel to the attachment surface 20*b*. Hence, in the second embodiment, the first outer surface portion 70, the second outer surface portion 72 and the alignment ribs 76 extend parallel to the attachment surface 20*b*. The first end 60 of the dummy connector 22' is fixed to the attachment surface 20*b* by the ribs 50, with the second end 62 being spaced apart from the attachment surface 20*b* and being cantilevered from the first end 60 to allow installation of the electric connector 24 (not shown in FIG. 17).

The various vehicle elements other than the trim panel 20 are conventional components that are well known in the art. Since such vehicle elements are well known in the art, these structures will not be discussed or illustrated in detail herein. Rather, it will be apparent to those skilled in the art from this disclosure that the components can be any type of structure and/or programming that can be used to carry out the present invention.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiments, the following directional terms "forward", "rearward", "above", "downward", "vertical", "horizontal", "below" and "transverse" as well as any other similar directional terms refer to those directions of a vehicle equipped with the trim panel. Accordingly, these terms, as utilized to describe the present invention should be interpreted relative to a vehicle equipped with the trim panel.

The term "configured" as used herein to describe a component, section or part that is constructed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A trim panel comprising:

a main body having a trim surface and an attachment surface opposite the trim surface;

a plurality of attachment structures formed on the attachment surface that are configured to contact and engage a separate panel securing the main body to the separate panel and covering an aperture formed in the separate panel; and a dummy electric connector formed on the attachment surface, the dummy electric connector being configured to receive and retain an electric connector in the absence of any electrical contacts within or on the dummy electric connector, the dummy electric connector including a hollow structure having a first end fixed to the attachment surface of the main body and a second end space apart from the attachment surface, the second end having an opening exposing a hollow interior of the hollow structure, the hollow interior being configured to receive at least a portion of the electric connector, the hollow structure also having a first outer surface portion with at least one electric connector retaining projection extending therefrom.

2. The trim panel according to claim 1, wherein the hollow structure has a second outer surface portion perpendicular to the first outer surface portion, the second outer surface portion having an alignment rib extending therefrom.

3. The trim panel according to claim 2, wherein the alignment rib extends in a direction perpendicular to the attachment surface.

4. The trim panel according to claim 1, wherein the first outer surface portion extends in a direction perpendicular to the attachment surface.

5. The trim panel according to claim 1, wherein the attachment structures include a plurality of first attachment projections extending from the attachment surface proximate a first edge of the main body and a plurality of second attachment projections extending from the attachment surface proximate a second edge of the main body opposite the first edge.

6. The trim panel according to claim 1, wherein the dummy electric connector defines an insertion direction for attachment to the electric connector that is perpendicular to the attachment surface.

7. A trim panel according comprising:

a main body having a trim surface and an attachment surface opposite the trim surface;

a plurality of attachment structures formed on the attachment surface that are configured to contact and engage a separate panel securing the main body to the separate panel and covering an aperture formed in the separate panel; and a dummy electric connector formed on the attachment surface, the dummy electric connector being configured to receive and retain an electric connector in the absence of any electrical contacts within or on the dummy electric connector, the dummy electric connector defining an insertion direction for attachment to the electric connector that is parallel to the attachment surface.

8. A trim panel assembly comprising:

a first trim panel having a first side and a second side opposite the first side, the first trim panel defining an aperture extending from the first side to the second side, the aperture being dimensioned and configured to receive a brake lamp device; and a second trim panel having a main body having a trim surface and an attachment surface opposite the trim surface, the attachment surface including a plurality of attachment structures configured to attach the second trim panel to the first trim panel covering the aperture, the attachment surface further including a dummy electric connector formed thereon, the dummy electric connector being configured to receive and retain an electric connector in the absence of the brake lamp device.

9. The trim panel assembly according to claim 8, further comprising a wiring harness having an electrical connector configured to attach to the brake lamp assembly, the electrical connector being attached to the dummy electric connector in order to prevent movement of the electric connector when not attached to the brake lamp assembly.

10. The trim panel assembly according to claim 8, wherein the first side of the first rim panel defines a rear shelf within a passenger compartment adjacent to a rear window of a vehicle.

11. The trim panel assembly according to claim 8, wherein the dummy electric connector includes a hollow structure having a first end fixed to the attachment surface of the main body and a second end space apart from the attachment surface, the second end having an opening exposing a hollow interior of the hollow structure, the hollow interior being configured to receive at least a portion of the electric connector.

12. The trim panel according to claim 11, wherein the hollow structure has a first outer surface portion having at least one electric connector retaining projection extending therefrom.

13. The trim panel according to claim 11, wherein the hollow structure has a second outer surface portion perpendicular to the first outer surface portion, the second outer surface portion having an alignment rib extending therefrom.

14. The trim panel according to claim 13, wherein the alignment rib extends in a direction perpendicular to the attachment surface.

15. The trim panel according to claim 12, wherein the first outer surface portion extends in a direction perpendicular to the attachment surface.

16. The trim panel according to claim 8, wherein the attachment structures include a plurality of first attachment projections extending from the attachment surface proximate a first edge of the main body and a plurality of second attachment projections extending from the attachment surface proximate a second edge of the main body opposite the first edge.

17. The trim panel according to claim 8, wherein the dummy electric connector is formed on the attachment surface in the absence of any electrical contacts within or on the dummy electric connector.

18. The trim panel according to claim 8, wherein the dummy electric connector defines an insertion direction for attachment to the electric connector that is perpendicular to the attachment surface.

19. The trim panel according to claim 8, wherein the dummy electric connector defines an insertion direction for attachment to the electric connector that is parallel to the attachment surface.

* * * * *